United States Patent [19]

Saggs

[11] Patent Number: 4,573,218

[45] Date of Patent: Mar. 4, 1986

[54] CONVERTIBLE LENGTH GARMENT

[76] Inventor: Gordon J. Saggs, 115 E. 9th St., New York, N.Y. 10023

[21] Appl. No.: 635,891

[22] Filed: Jul. 30, 1984

[51] Int. Cl.[4] ..... A41D 1/02; A41D 1/00; A41D 27/10

[52] U.S. Cl. ..... 2/93; 2/108; 2/269

[58] Field of Search ..... 2/93, 269, 70, 74, 76, 2/108

[56] References Cited

U.S. PATENT DOCUMENTS

| | | | |
|---|---|---|---|
| 2,602,163 | 7/1952 | Davenport | 2/269 X |
| 3,665,516 | 5/1972 | Orovan | 2/269 |
| 4,149,275 | 4/1979 | Sanchez | 2/269 |
| 4,347,629 | 9/1982 | Itoi | 2/108 |

*Primary Examiner*—Doris L. Troutman

[57] ABSTRACT

A garment is constructed from flexible and joined panels, such as waterproofed cloth panels. The garment has a top portion, a bottom portion and a foldable lengthening panel which is folded once and hidden behind the bottom portion when the garment is shortened. The foldable lengthening panel extends completely around the garment and a long zipper also extends completely around the garment. One side of the zipper is attached to the lower edge of the bottom portion and the other side of the zipper is attached to the upper edge of the bottom portion or the lower edge of the lengthening panel.

10 Claims, 7 Drawing Figures

CONVERTIBLE LENGTH GARMENT

BACKGROUND OF THE INVENTION

The present invention relates to garment construction and more particularly to convertible garments.

At the present time the use of short lightweight jackets, both pull-over types and front opening types, are very popular. However, in inclement weather, and especially in a heavy rainfall, such short jackets do not provide full protection from the rain.

An alternative is to wear a long raincoat. But, if the sun is out, one does not want to wear a raincoat.

One may also take along on a trip both a jacket and a raincoat, but the two garments may be bulky to pack and heavy to carry.

It is known, in some types of fur coats, to add an extra bottom panel, to convert the coat from street length to floor length (day time to formal), by snapping on an extra bottom circumferential panel which panel, unused, was kept at home.

OBJECTIVES AND FEATURES OF THE INVENTION

It is an objective of the present invention to provide a garment which converts, from a short garment, such as a jacket, to a longer garment, such as a raincoat, in one simple operation, and which may be reconverted to the form of the original garment.

It is a further objective of the present invention to provide such a garment whose appearance, both when shortened and lengthened, is acceptable to customers and which is not bulky in its shortened form;

It is a further objective of the present invention to provide such a garment in which the conversion is made simply and rapidly.

It is a further objective of the present invention to provide such a garment which utilizes commercially available materials and components, so that it may be produced at a reasonable cost and sold at a reasonable price.

It is a further objective of the present invention to provide such a garment which is readily converted into a raincoat.

It is a feature of the present invention to provide a garment which may be readily lengthened or shortened by the user. For example, the garment may be a short jacket which may be lengthened to a raincoat. The garment includes a top garment portion having front and back panels and sleeves attached thereto and a bottom garment portion including front and back panels.

A lengthening panel is attached to, and between, the top and bottom portions. It is foldable and unseen when the garment is shortened and is unfolded and seen when the garment is lengthened. The lengthening panel extends circumferentially around the garment. A zipper extends circumferentially about the garment and has one side attached to the lower edge of the bottom portion and its other side attached to the upper edge of the bottom portion or the bottom edge of the lengthening panel. When the zipper is closed, the lengthening panel is folded and unseen behind the bottom portion. The zipper is opened to permit the lengthening panel to unfold.

It is another feature of the present invention that the bottom garment front and back panels form a unitary onepiece panel and that the top portion may be a pull-over having a front exposed pocket with a flap attached to said top portion.

BRIEF DESCRIPTION OF THE DRAWINGS

Other objectives and features of the present invention will be apparent from the accompanying drawings.

In the drawings.

DETAILED DESCRIPTION OF THE INVENTION

Figure 1:
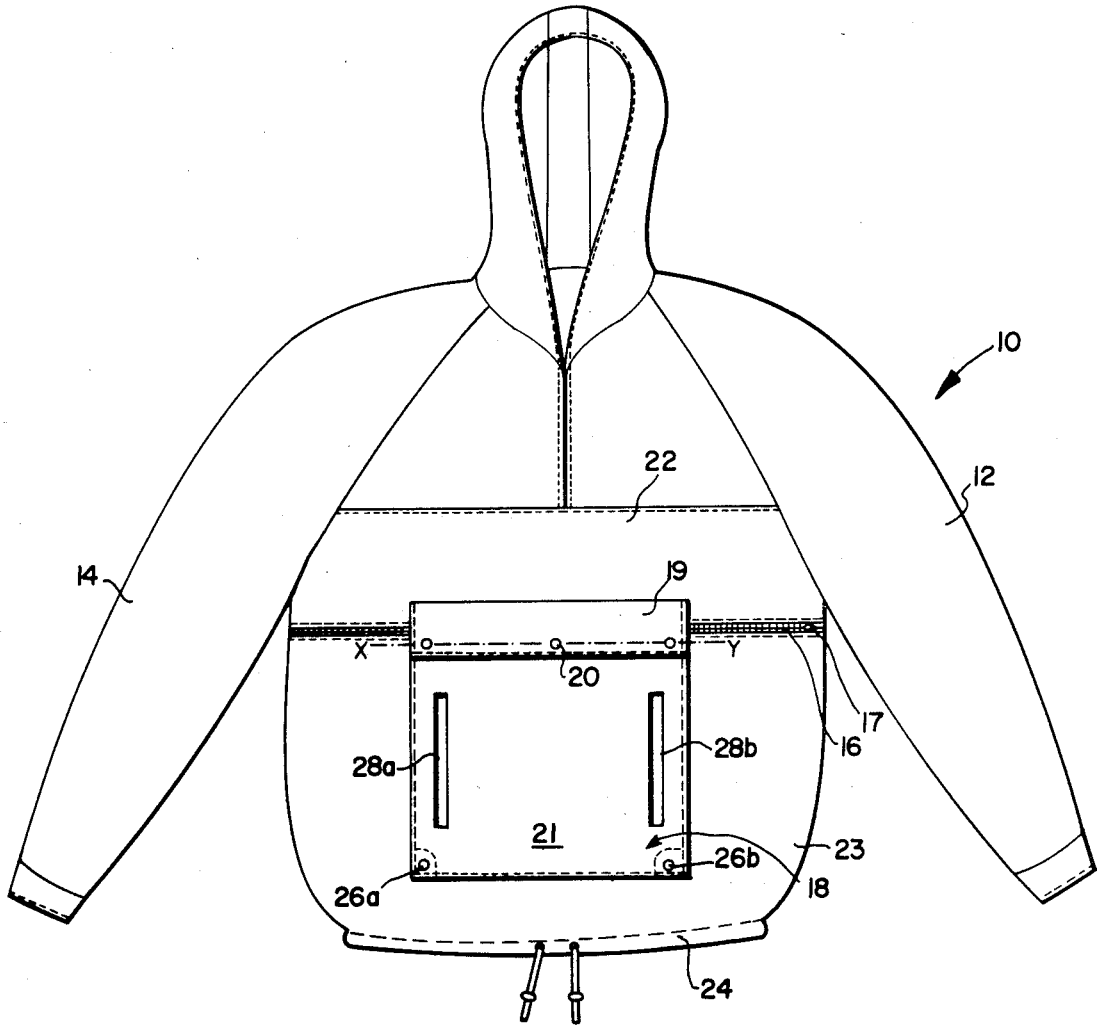
FIG. 1 is a front plan view of a pull-over jacket in accordance with the present invention, shown in its shortened position.
Figure 2:
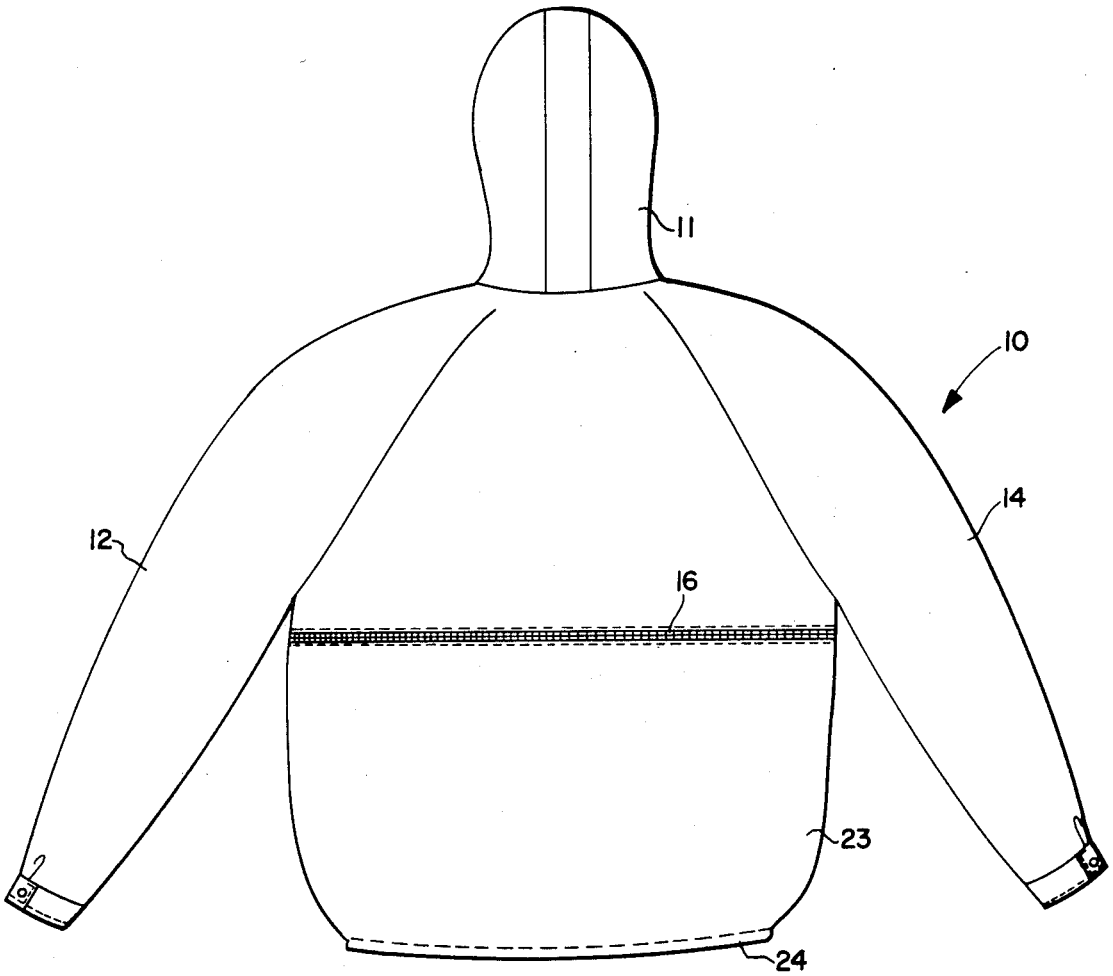
FIG. 2 is a rear plan view of the jacket of FIG. 1 shown in the same position.
Figure 3:
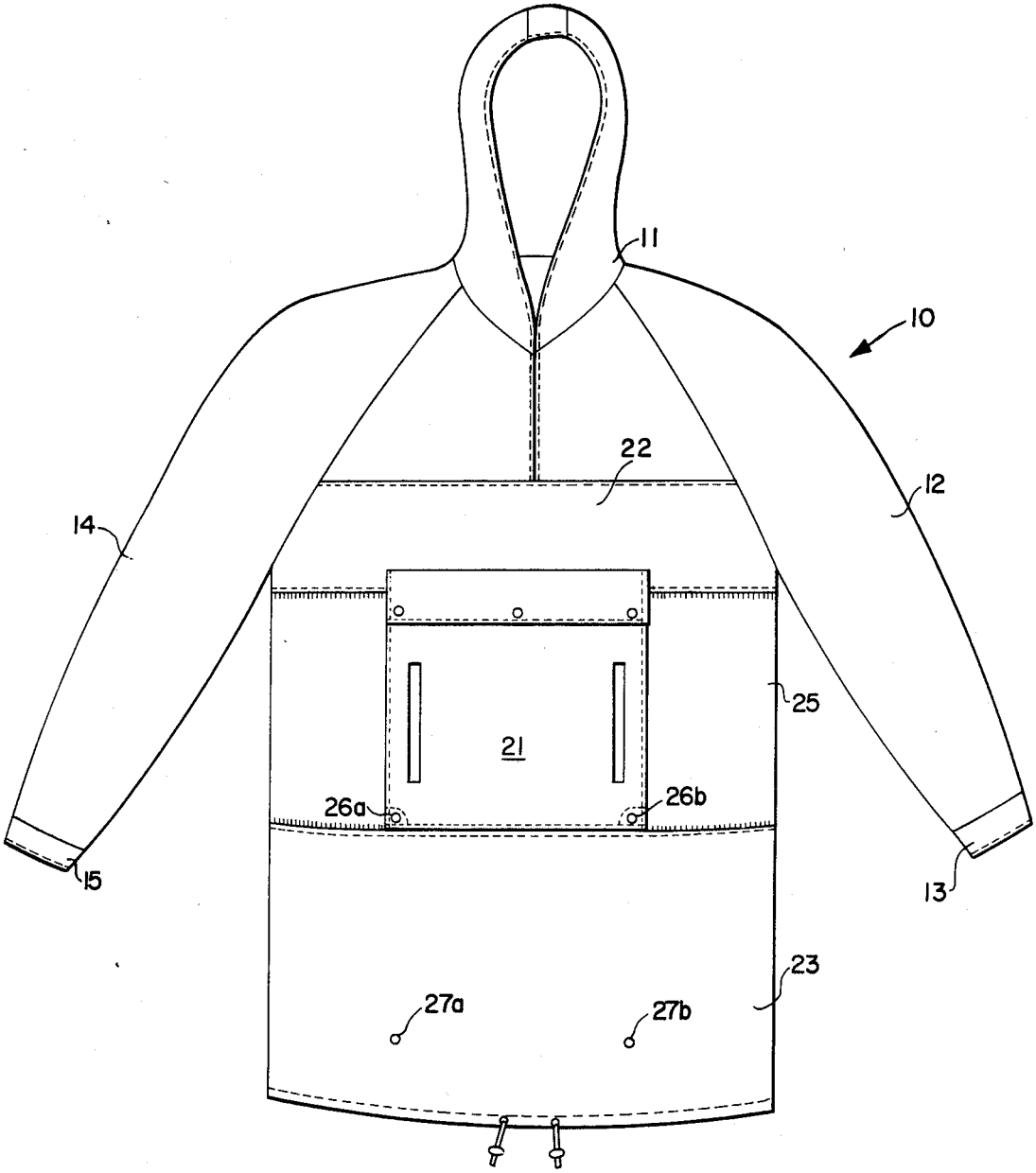
FIG. 3 is a front plan view of the jacket of FIG. 1, shown in its extended position.

As shown in FIGS. 1–3, the present invention will first be described in connection with a pull-over jacket. The jacket may be worn by either men, women or children. The jacket includes portions which are conventional to other types of pull-over jackets and includes a hood 11, a left sleeve 12 having a cuff 13, and a right sleeve 14 having a cuff 15.

As shown in FIG. 1, the jacket 10 has a zipper 16 having a zipper puller 17. The zipper preferably is relatively large in size and of the type known as an "industrial zipper" and is constructed with plastic resin teeth. Zipper 17 completely encircles the jacket 10.

A large pocket 18 is connected at the front of the jacket. The flap 19 of the pocket 18 covers a portion of the zipper 16 and is connected by openable female snaps 20 to male snaps at the top of the front face 21 of the pocket 18. Alternatively, and not shown, the flap 19 may extend completely around the body and completely cover the zipper 16.

The top of the flap 19 is sewn to the mid-section panel 22 of the jacket 10 along the line X-Y so that it hinges. The mid-section panel 22 is removably connected to the panel 23 by the zipper 16. One side of the zipper 16 is sewn to panel 22 and the other side of the zipper is sewn to panel 23. A draw cord 24 is located at the bottom of the panel 23 and is used to close the bottom of the jacket.

As shown in FIG. 3, the zipper 16 may be completely opened, exposing an additional panel 25. The panel 25 extends completely around the body of the jacket 10 and is folded under panel 23, so as not to be seen when the zipper 16 is closed.

Before the zipper 16 is opened, the bottom female snaps **26*a* and 26*b* are unsnapped from their male snaps 27*a* and 27*b* which are on the panel 23. The female snaps 26*a* and 26*b* may then be snapped onto male female snaps underneath them and attached to the panel 25**, or the jacket may hang unfastened at its bottom edge.

The panel 25, as shown in FIG. 3, in its open position, extends the length of the jacket 10. The jacket 10 which in FIG. 1 had been a jacket tied at the waist, in FIG. 3 becomes a longer garment which will protect against rain.

The pocket 21 has side openings 28*a* and 28*b*. Preferably the garment of the present invention is made of lightweight cloth material such as waterproofed nylon or poplin.

The typical dimensions for the jacket 10 are as follows: back length 26 inches, cuff 2 inches, draw cord 36 inches, and three ring snaps on flap and one on each of the two bottom corners of the pocket. Preferably the garment may be folded or rolled so that it is readily packed for travel in a small package.

Figure 4:
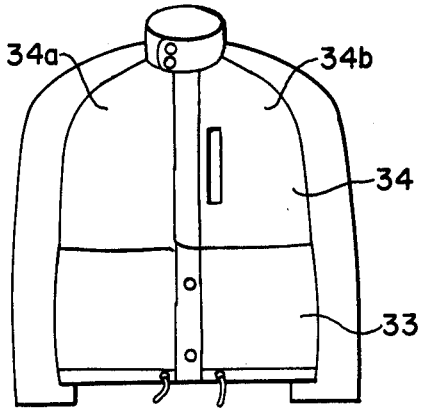
FIG. 4 is a front plan view of an alternative jacket in accordance with the present invention.
Figure 5:
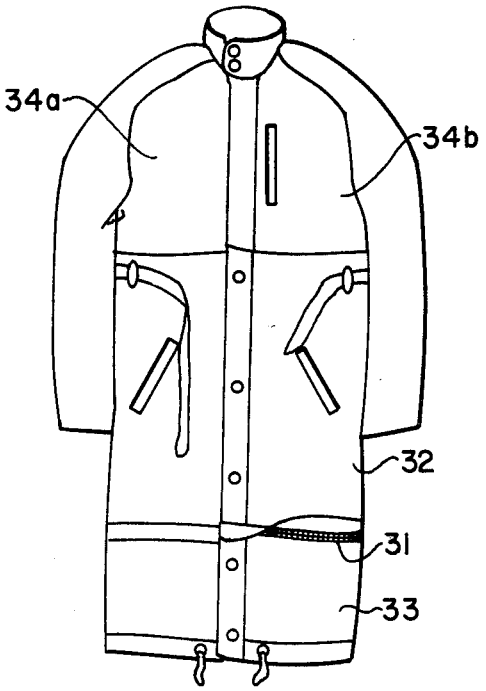
FIG. 5 is a front plan view of a raincoat which is unfolded from the jacket shown in FIG. 4.
Figure 6:
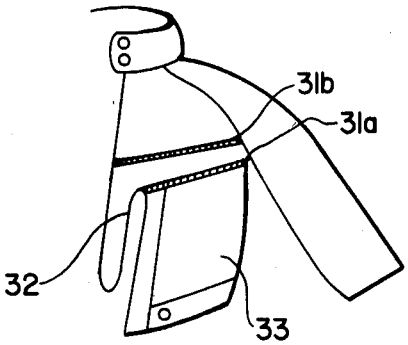
FIG. 6 is a perspective view showing the folds and zipper of the jacket of FIG. 4.

An alternative garment, within the scope of the present invention, is the convertible jacket-raincoat 30 shown in FIGS. 4 and 5. The zipper 31 has its bottom side 31*a* sewn to the bottom of the lengthening panel 32. To form the jacket (FIG. 4) from the raincoat (FIG. 5), the panel 32 is folded in half, as shown in FIG. 6, and the zipper bottom side 31*a* is joined to the zipper top side 31*b*. The lengthening panel 32 is then hidden behind the garment bottom portion 33. The zipper top side 31*b* is hidden beneath the panels of the top portion 34 consisting, at its front, of left panel 34*b* and right panel 34*a*.

Figure 7:
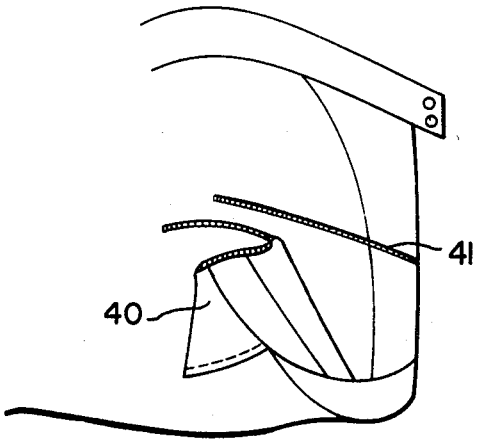
FIG. 7 is a perspective view showing the folds and the zipper as utilized on a jacket in an alternative embodiment of the present invention.

In the alternative embodiment, shown in FIG. 7, the lengthening panel 40 is folded inside of the garment. The zipper 41 is inside the garment. The exterior of the garment, when it is shortened, consists of the top portion and one-half of the lengthening panel. When it is lengthened, the exterior consists of the top portion, the full lengthening panel and the bottom portion.

What is claimed is:

1. A garment which is a combined jacket and raincoat of flexible and attached panels which may be readily repeatedly and rapidly lengthened to form the raincoat or shortened to form the jacket by the user, the garment including:

a top garment portion having a lower edge with a circumference and including front and back panels and sleeves attached thereto;

a bottom garment portion having an upper edge with the same circumference as the circumference of the said lower edge, including front and back panels;

a lengthening panel attached to and between said top and bottom portions and which is foldable and unseen when the garment is shortened and which is unfolded, seen and adds to its length when the garment is unfolded, said lengthening panel extending circumferentially about the garment; and a zipper extending continuously and circumferentially about the garment and having one side attached to the lower edge of the top portion and its other side attached to the upper edge of the bottom portion so that when the zipper is closed the lengthening panel is folded unseen behind the bottom portion and the zipper is viewable on the exterior of the jacket.

2. A garment as in claim 1 wherein said lengthening panel is composed of front and back panels joined by side seams.

3. A garment as in claim 1 wherein said bottom garment front and back panels are a unitary one-piece panel.

4. A garment as in claim 1 wherein said top portion includes a hood and the garment is a pull-over having a front exposed pocket with a flap attached to said top portion.

5. A garment as in claim 3 and further including snaps on the front face of said bottom portion, snaps on the front face of said lengthening panel and snaps near the bottom inside edge of said pocket, which bottom portion snaps and lengthening panel snaps removably fasten to said snaps on said pocket.

6. A garment which is a combined jacket and raincoat of flexible and attached panels which may be readily repeatedly and rapidly lengthened to form the raincoat or shortened to form the jacket by the user, the garment including:

a top garment portion having a lower edge with a circumference and including front and back panels and sleeves attached thereto;

a bottom garment portion having an upper edge with the same circumference as the circumference of the said lower edge, including front and back panels;

a lengthening panel attached to and between said top and bottom portions and which is foldable and unseen when the garment is shortened and which is unfolded, seen and adds to its length when the garment is unfolded, said lengthening panel extending circumferentially about the garment; and a zipper extending continuously and circumferentially about the garment and having one side attached to the lower edge of the lengthening panel and its other side attached to the lower edge of the bottom portion so that when the zipper is closed the lengthening panel is folded unseen behind the bottom portion and the zipper is visible on the exterior of the jacket.

7. A garment as in claim 5 wherein said lengthening panel is formed of front and back panels joined by side seams.

8. A garment as in claim 6 wherein said bottom garment front and back panels are a unitary one-piece pnael.

9. A garment as in claim 6 wherein said top portion includes a hood and the garment is a pull-over having a front exposed pocket with a flap attached to said top portion.

10. A garment as in claim 9 and further including snaps on the front face of said bottom portion, snaps on the front face of said lengthening panel and snaps near the bottom inside edge of said pocket, which bottom portion snaps and lengthening panel snaps removably fasten to said snaps on said pocket.

* * * * *